US008495763B2

(12) United States Patent
Gafforio et al.

(10) Patent No.: US 8,495,763 B2
(45) Date of Patent: Jul. 30, 2013

(54) SAFETY HELMET WITH RAISABLE CHIN-GUARD

(75) Inventors: Luca Gafforio, Comun Nuovo (IT); Gabriele Tomasoni, Bariano (IT); Alberto Salvetti, Bergamo (IT)

(73) Assignee: Nolangroup S.p.A., Brembate di Sopra (BG) (IT)

( * ) Notice: Subject to any disclaimer, the term of this patent is extended or adjusted under 35 U.S.C. 154(b) by 314 days.

(21) Appl. No.: 12/893,368

(22) Filed: Sep. 29, 2010

(65) Prior Publication Data

US 2011/0078846 A1 Apr. 7, 2011

(30) Foreign Application Priority Data

Oct. 7, 2009 (EP) ..... 09425392

(51) Int. Cl.
*A42B 1/08* (2006.01)

(52) U.S. Cl.
USPC ..... 2/6.2; 2/424

(58) Field of Classification Search
USPC ..... 2/6.2, 6.5, 421, 422, 424, 425
See application file for complete search history.

(56) References Cited

U.S. PATENT DOCUMENTS 4,689,836 A * 9/1987 Vitaloni ..... 2/424
6,249,918 B1 * 6/2001 Lacroix ..... 2/424
7,024,704 B2 * 4/2006 Gafforio et al. ..... 2/424
7,376,981 B2 * 5/2008 Shida ..... 2/424
7,398,561 B2 * 7/2008 Kim et al. ..... 2/424

* cited by examiner

*Primary Examiner* — Katherine Moran
(74) *Attorney, Agent, or Firm* — Lucas & Mercanti, LLP

(57) ABSTRACT

Safety helmet of the type comprising a chin guard rotatably pivoted to the shell between a pulled down position, at the lower end of the front opening of the shell, and at least one raised position over said front opening, and at least one reversible locking device of the chin guard in such at least one raised position, the reversible locking device comprising at least one follower, integrally rotatable with the chin guard, and at least one corresponding countering element, constrained with at least one degree of freedom to the shell, or vice versa, such countering element being intended for its engagement with the aforesaid at least one follower at least in proximity of said raised position of the chin guard, as well as means for manually regulating the position and/or the motion of said at least one countering element. Such at least one countering element is movable between at least one locking position, by contrast of rigid parts, of the aforesaid at least one follower, when the chin guard is at or in proximity of its raised position, and at least one disengagement position of such follower from the countering element, the means for regulating the position and/or the motion of the aforesaid at least one countering element allowing or preventing the same countering element to stably maintain the aforesaid at least one locking position by contrast of rigid parts for said at least one follower.

11 Claims, 7 Drawing Sheets

SAFETY HELMET WITH RAISABLE CHIN-GUARD

CROSS-REFERENCE TO RELATED APPLICATION

This application claims the benefit of priority from European Patent Application Number 09425392.9 filed Oct. 7, 2009, the contents of which are incorporated herein by reference.

FIELD OF THE INVENTION

The present invention concerns to a safety helmet, particularly suited for motorcycle use, of the type provided with a chin guard that, pivoted to the helmet shell, may be pulled down by the user to the lower end of the front opening of the shell itself and raised, when particular needs occur, over such a front opening.

BACKGROUND ART

Such a safety helmet, that in the motorcycle field goes with the traditional integral helmets, that are provided with a chin guard integral to the shell, and the so-called "jet" helmets, without the chin guard, usually provides a reversible mechanism for fixing the chin guard in a position protective the lower portion of the user face, that is in a pulled down position, that has to permanently assure such a position maintaining in case of impact too.

These mechanisms for reversibly fixing the chin guard in the pulled down position, that in a simple embodiment thereof may comprise, for example, elastic hooks pivoted to the chin guard which, thanks to the operating of specific tie rods or struts connected with such hooks and operated by a manual control, are driven by the user in engagement and/or disengagement positions with corresponding strikers provided on the shell of the helmet itself, usually do not provide any stable fixing of the chin guard, when this latter is in its raised position.

For such reasons it is therefore recommended that, with such helmets, the user has to utilize the helmet operatively with the chin guard in a pulled down position protective the face of the user itself, so to obtain a helmet comparable with the so-called integral helmets.

However, in some cases in practice, it may be useful or necessary maintaining the chin guard in a raised position, so to obtain a helmet comparable with a "jet" type helmet.

Concerning this, it is known art to provide such a helmet type, with a raisable chin guard, not only with the aforesaid fixing mechanism in a pulled down position, but with a device for reversible locking, that is user controlled, the chin guard in its raised position as well.

Devices for reversible locking the chin guard in the raised position may comprise, in a simplified embodiment thereof, an elastic stop that, placed on the shell so that to engage with the chin guard only when this latter is in proximity of its raising position, in normal conditions is opposing to the chin guard rotation, unless the user would not exercise on the chin guard itself a force sufficient for temporarily deforming such an elastic stop and thereby allowing the chin guard rotation resumption.

For example, the U.S. Pat. No. 6,249,918 (LACROIX) provides that such a device for locking the chin guard in a raised position comprises a circular guide groove, integral with the shell, provided in the interior with an elastic projection transversally and partially protruding into such a guide groove. The chin guard is, in its turn, provided with a projection, or follower, that is slidingly coupled inside the guide groove such that, during its raising or pulling down, such a follower will move within the circular groove integral with the shell. The elastic projection is placed inside the groove so that, when the chin guard is in proximity of its position of highest raising, it would interfere with the aforesaid follower, thereby acting as an elastically yielding stop.

Only when the user exercises a force that is able to temporarily deform such an elastic projection, the follower, integral with the chin guard, will be able to go past the elastic projection and reach the limit stop defined by the guide groove, corresponding to the position of highest raising of the chin guard. In absence of countering forces, when the follower will arrive at such a limit-stop position, the elastic projection will be able to hold the chin guard in its position of highest raising.

In the same way, the European Patent Application EP-A-0895726 in the name of LOCATELLI, describes a safety helmet provided with a raisable chin guard, comprising an elastic projection, integral with an inner wall of the chin guard, that could engage into a complementary seat obtained on the shell, when the chin guard is in proximity of its raised position. The engagement or disengagement of the elastic projection into the complementary seat takes place only if it is exercised by the user a force sufficient to allow the elastic collapse of the aforesaid projection.

Such type of devices, substantially based on the strength opposed by an elastically deformable element integral to the shell, against a rigid element integral to the chin guard, or vice versa, although simply structured and realized, nevertheless reveal poor effectiveness in maintaining the chin guard in its raised position, because it is sufficient the exercise of an accidental force against the chin guard, although not so excessive, to unlock this latter from its raised position and cause an undesirable pulling down.

In fact, as it will be evident to a person skilled in the art, it is not possible to excessively stiffen the elastically deformable element, because if this latter is too much rigid, although it prevents the accidentally exercised forces from causing the sudden pulling down of the chin guard, once this latter is in its raised position and held by the aforesaid reversible locking device, it will be difficult for the user to overcome the strength provided by the same elastically deformable element during the raising/pulling down step of the chin guard, and, in case of pulling down, the stiffness of the elastically deformable element may cause, if the force exercised by the user is sufficient, an undesirable rotation downward of the helmet (in this case integral with the chin guard), or a sudden undesirable pulling down of the chin guard may occur.

In the International Application WO-A-2006045912 in the name of SHARK a different, user controlled, device is described for reversibly locking the chin guard in its raised position, nay turned over, in helmets having a turning over chin guard.

The locking device described in the SHARK patent application provides that the chin guard is connected to the shell by a rotatable and sliding constrain (that is a slider) and that the motion and the chin guard position, during the raising and pulling down operations, are defined by the engagement of a follower, integral to the chin guard, into a guide groove, obtained on the shell.

The shape of the guide groove is such that the chin guard could reach an extremely rearward position on the shell relatively to the front opening of the shell itself. The guide groove further provides some limit-stop inlets for the follower, preventing the user from moving the chin guard from the corresponding limit stop without the user itself exercises a complicated roto-translation of the same chin guard.

However such a device, although simple and effective for locking the chin guard in the raised position, obliges the user to exercise on the chin guard forces in unusual and difficult to execute direction and ways. Further such a device does not allow to raise temporarily the chin guard, without this latter being locked in its raised position (turned over).

It is an object of the present invention to carry out a safety helmet with a turning over chin guard of the type comprising a device for locking the chin guard in a raised position not presenting the drawbacks of the prior known art, above reported.

It is further an object of the present invention to carry out a safety helmet with a turning over chin guard comprising a device for locking the chin guard in a raised position, allowing to effectively lock the chin guard in a raised position only when the user wants to, and in the meanwhile being easy to operate by the user.

A further object of the present invention is to provide a safety helmet with a turning over chin guard comprising a device for locking the chin guard in a raised position, allowing, at user discretion, both a stable locking and a yielding locking, that is of the type wherein only one elastic or friction countering element, or an unstable rest is opposing to the chin guard motion, that is easy and practical to plan and carry out.

SUMMARY OF THE INVENTION

These and other objects are obtained by the safety helmet with turning over chin guard according to the first independent claim and the following dependent claims.

The safety helmet, according to the present invention, comprises a chin guard rotatably pivoted to the shell between a pulled down position, at the lower end of the front opening of the helmet itself, and at least one raised position over the aforesaid front opening, as well as at least one reversible locking device for the chin guard in the aforesaid at least one raised position. Such a temporarily locking device comprises at least one follower, integrally rotatable with the chin guard, and at least one corresponding countering element, constrained with at least one degree of freedom—and preferably hinged—to the shell, or vice versa, wherein such a countering element is intended for its engagement with the follower at least in proximity of the raised position of the chin guard. Such a device comprises means for manually regulating the position and/or the motion of the countering element. Advantageously, according to the invention, the aforesaid countering element is movable between at least one locking position, by contrast of rigid parts, for the aforesaid follower, when the chin guard is placed at, or in proximity of, its raised position, and at least one disengagement position of the follower from the countering element. Further, the means for regulating the position and/or the motion of the countering element allow or prevent such a countering element to stably maintain the aforesaid locking position by contrast of rigid parts of the follower.

The use of a shaped body—the so-called countering element—intended for reversibly constraining the chin guard in its raised position by contrast of rigid parts, that is these latter being without elastic regions, allows to stably hold the chin guard in that position, also in case of undesirable forces exercising against the same chin guard. The use of means for operating such countering element, so that it adopts the aforesaid stable locking position, further allows the user to simply and freely operate such a locking device of the raised chin guard.

Further, according to a preferred aspect of the present invention, the countering element is mobile as well to a resting position of unstable engagement of the aforesaid follower, when the chin guard is at or in proximity of its raised position. Such means for regulating the position and/or the motion of the countering element may further temporarily hold the countering element in the aforesaid resting position of unstable engagement, for the follower.

The further presence of a countering element position wherein an unstable rest occurred, that is a position destined to failed in case wherein an undue sufficient force is exercised to the chin guard, between the countering element and the follower, for example realized by rendering elastic the aforesaid countering element in certain positions thereof, or by elastic bodies, or by bodies having a high friction for temporarily holding the follower, or by an unstable resting plane for the follower, will allow the user to select if locking in a stable or only in a temporarily way the chin guard in the raised position.

According to a further aspect of the present invention, the countering element comprises as well at least one first superficial portion for the follower unstable rest, wherein such a first portion would engage the follower when the countering element is maintained, by the regulating means, in its first locking position by contrast of rigid parts, and at least one second superficial portion for the yielding rest of the follower, wherein such a second portion would engage the follower in a unstable and yielding rest, when the means for regulating the position and/or the motion of the countering element place this latter in the aforesaid resting position of unstable engagement, for such a follower.

It has to be observed that, in the particular embodiment of the afore described invention, an appropriate return spring, belonging to the aforesaid regulating means and for example interposed between the countering element and the helmet shell, allows to render the countering element elastically yielding, when the regulating means allow the same countering element to move in its disengagement position from the follower.

Such an embodiment, that will be explained more in detail below, allows to simply and effectively obtain a device for locking the chin guard in a raised position, wherein the countering element, manually operable by the user, may be easily placed in two chin guard positions of yielding rest and reversible lock, respectively, in its raised position.

BRIEF DESCRIPTION OF THE DRAWINGS

For purposes of illustrations and not limitative a preferred embodiment of the present invention will be provided with reference to the accompanying drawings, in which.

DETAILED DESCRIPTION OF A PREFERRED EMBODIMENT OF THE INVENTION

Figure 1:
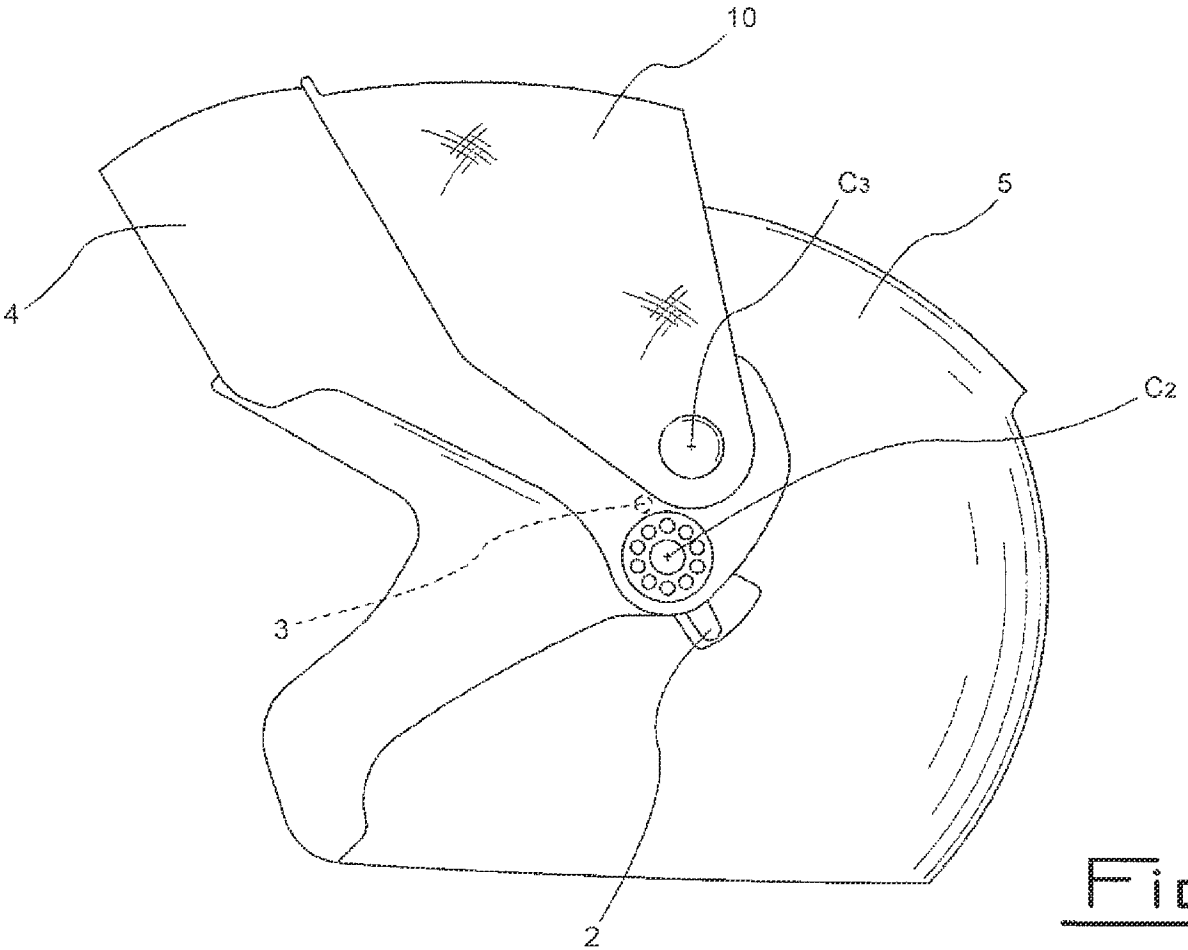
FIG. 1 is a side view of a safety helmet with a turning over chin guard, according to a preferred aspect of the present invention.

Firstly referring to FIG. 1, the herein shown safety helmet, particularly suited for motorcycle use, according to a particular aspect of the present invention, is of the type comprising a shell 5, provided with a front opening also extending below, to allow the user to put on the helmet itself, and a chin guard 4 hinged in C2 to the two sides of the shell 5, in proximity of the side endings of the same front opening of the shell 5.

At least an appropriate visor 10 for the user may be hinged (in C3 in FIG. 1) to the chin guard 4, as known in the art, having the task of protective the user face from the air flows and/or possible corpuscles flowing in the air, while allowing the user an optimal outward view.

The chin guard 4 and the shell 5, according to the known art, are shaped in such a way that would be possible the manual rotation of the chin guard 4 between a pulled down position, at the lower end of the aforesaid frontal opening, wherein the protection of the user face is obtained, and at least one raised position, wherein such a chin guard 4 does not interfere with the frontal helmet opening.

The geometry of the chin guard 4 and shell 5 is such to allow both the coupling by contact of adjacent parts of the lower end of the shell 5 with the chin guard 4, when this latter is in its pulled down position, and the achievement of at least one raised position, wherein the chin guard 4 does not interfere or limit the frontal visual field of the user.

As known, although herein not represented, the chin guard 4 is provided with a mechanism for its reversible fixing to the shell 5 in a pulled down position, having the object of preventing casual movements of the chin guard 4 itself, when this latter is in its aforesaid position for protective the user face.

The safety helmet herein illustrated (see for example FIG. 2) comprises as well a device 1, 3 for reversibly locking the chin guard 4 in a raised position, that, referring to the whole figures, comprises a countering element 1, constrained with one degree of freedom to the shell 5 of the helmet, and a corresponding follower 3, rotationally integral with the chin guard 4. The helmet further comprises means 2 for manually regulating the position and/or the motion of the aforesaid counter element 1, that allow such a counter element 1 to be placed in at least one position wherein the stable lock of the follower 3 would occur on the same countering element 1 (and hence of the chin guard 4), by contrast of rigid parts, and at least one disengagement position from such a follower 3, wherein this latter could freely rotate, integrally with the chin guard 4.

Figure 5B:
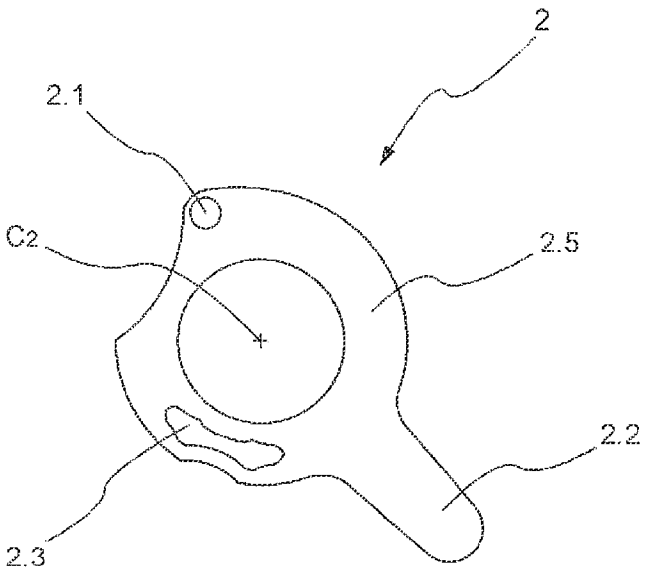
FIG. 5*b* is a side view of a particular means for regulating the motion and/or position of countering element of FIG. 5*a;*
Figure 5A:
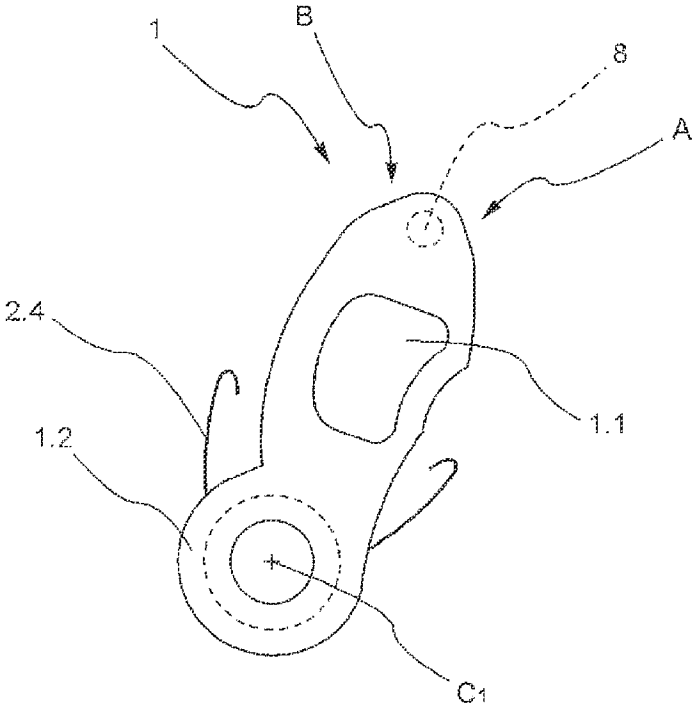
FIG. 5*a* is a side view of a particular countering element of the device of FIGS. 2-4.
Figure 6:
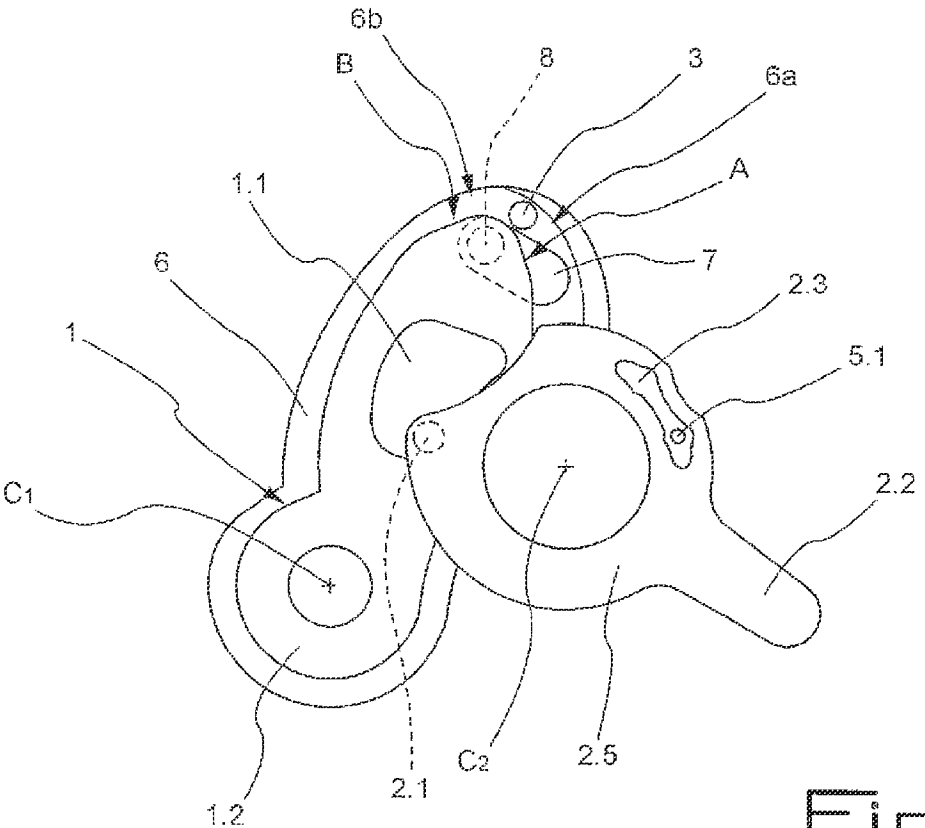
FIG. 6 is a schematic expanded side view of the device of preceding figures, when the chin guard is stably locked in the raised position.
Figure 7:
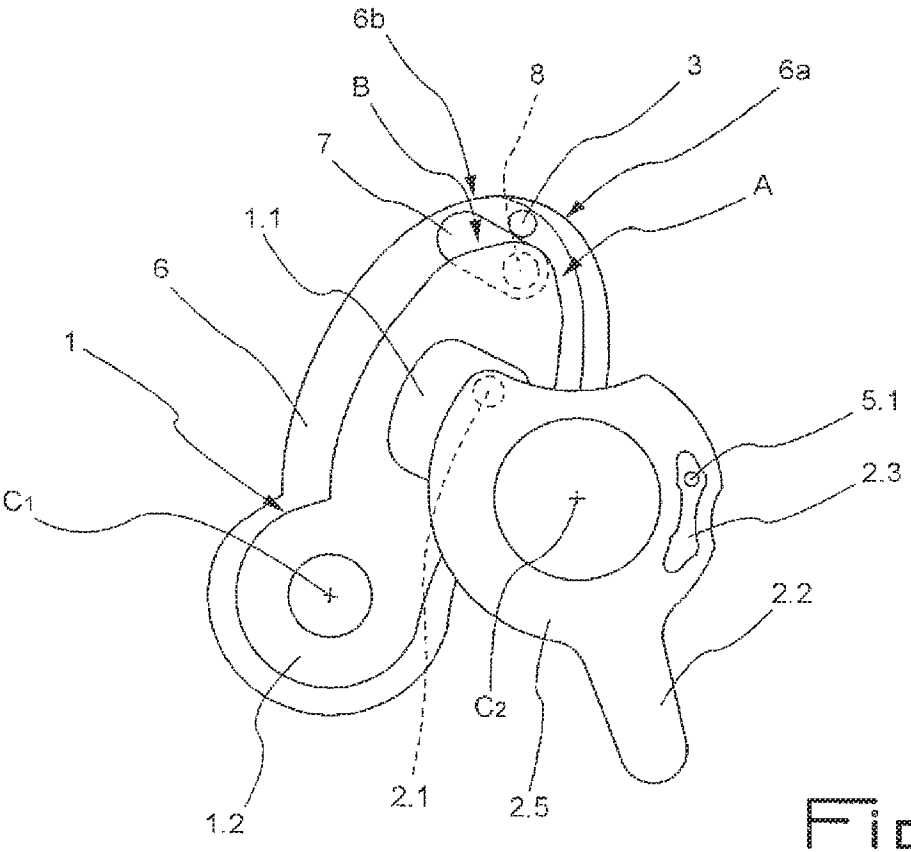
FIG. 7 is a schematic expanded side view of the device of preceding figures, when the chin guard is unstably engaged in its raised position.

In the particular embodiment of the present invention herein illustrated, the countering element 1, as can be seen for example in FIGS. 5*a*, 6 and 7, is composed of an extended body 1.2, cam shaped, that is hinged at its end in C1 to the shell 5 inside a proper seat 6, while the aforesaid follower 3 is composed of a cylinder projecting in the interior from a side end portion of the chin guard 4, in a position suited for engaging, at least in proximity of the raised position of the chin guard 4 itself, at least part of the side surface of the body 1.2 of the countering element 1, and particularly superficial portions of the upper head, opposite to the hinge C1, of the same countering element 1.

It has to be noticed that, in the embodiment of the present invention herein described, the countering element 1 and the follower 3 have different circular paths, because of difference between the corresponding swing centers C1, C2, said paths being designed however in such a way to intersect in many points and/or have one tangency point.

Any other solution that, providing one degree of freedom for the aforesaid countering element 1, would allow this latter to intersect, and/or be tangent to the follower 3 path will however fail in the inventive scope of the present invention.

The seat 6 is shaped in such a way to accommodate the follower 3, integral with the chin guard 4, along its whole rotation, from the pulled down position to the raised position of the chin guard 4, and it is shaped as well in such a way to present at least one upper stroke surface 6*a* for the follower 3, the surface acting as a upper limit stop for the same follower 3, and hence for the chin guard 4.

It has to be observed that, inside the seat 6, is obtained a circular guide 7 placed for accommodating, in a sliding way, a corresponding small tooth 8, internally projecting from the body 1.2 of the countering element 1. The circular guide 7 defines a upper limit stop and a lower limit stop for the rotation of the countering element 1, such that the run of this latter would not necessarily be limited (only) by the walls of the seat 6 itself.

As afore mentioned, the path kept by the follower 3, rotatable around the rotation axis C2 of the chin guard, intersects or is tangent with at least one or more corresponding portions A, B of the side surface of the body 1.2 of the countering element 1, according to the position assumed by this latter, which portions A and B are placed in proximity of, or at, the raised position of the chin guard 4 over the shell 5.

More in detail, it has to be observed that the follower 3 is guided, in its run integrally with the rotation of the chin guard 4, by a upper side wall 6*b* of the seat 6, thereby acting basically as a guide, and by a side wall outside the body 1.2 of the countering element 1.

That is, in the embodiment of this invention herein illustrated, the path kept by the follower 3 is tangent with the body 1.2 of the countering element 1 for the most of its run and, because of the specific shape of the upper head of the same body 1.2, such a path of the follower 3 will intersect the aforesaid portions A and B of the body 1.2, in case engaging the same, when the follower 3 will reach a position at, or in proximity of, its limit stop 6*a* (that is when the chin guard 4 is in proximity of, or at, its raised position) and when the countering element 1 will reach, or better is placed into, determined positions inside the seat 6.

As can be seen in the figures, the follower 3, in that length of its run wherein the chin guard 4 is in proximity of, or at, its raised position, may engage the portion A or, alternatively, the portion B, only when the countering element 1 is conveniently placed in proper positions for interception of the same follower 3, such positions whereby this latter will be constrained between the portion A of the countering element 1, and a upper surface 6*a* of the seat 6 or, alternatively, will be constrained between the aforesaid portion B of the element 1 and such a upper surface 6*a* of the seat 6 (see in particular FIGS. 6 and 7 respectively).

The helmet herein illustrated, according to a particular aspect of the present invention, will further comprise means 2 for manually regulating the position and/or the motion of the countering element 1, which are particularly suited for fixing such a countering element 1 in a determined position, or for limiting the motion of this latter, allowing the rotation only in angular ranges predefined in the design step, or only in a determined rotation direction.

In the case herein illustrated, such means 2 are composed of a rotatable disc 2.5, hinged in C2, which is provided with a control 2.2, in the form of an activating lever, and a striker 2.1 suited to control, with a return spring 2.4, the countering element 1.

Particularly, the striker 2.1, protruding below from the disc 2.5, is engaged within the guide 1.1 obtained, with an appropriate shape, on the body 1.2 of the countering element 1, so that to be able to rotate the same countering element 1 and/or to prevent the free rotation in one direction or in the opposite direction according to the adopted position.

Obviously, the operation of the activating lever 2.2, by the user, placed inside a seat 9 having the shape of circular sector, causes a corresponding rotation of the striker 2.1, integral with the disc 2.5, around its center C2, that in turn causes the corresponding rotationally activation of the countering element 1, just because of the engagement of the striker 2.1 inside the corresponding guide 1.1.

The return spring 2.4, interposed between the shell 5 and the body 1.2 of the countering element 1, preferably composed of a wire spring of the flexure type, is further shaped so that to return the countering element 1 in an initial position defined in the design step, and to thereby oppose to the rotation of the body 1.2 of the countering element 1 in a defined rotation direction.

Such a spring 2.4, in the embodiment herein shown of the present invention, pushes the countering element 1, hinged in C1, in such a way that its upper head (namely that one of its regions comprising the aforesaid portions A and B) would newly rotate around C1 towards the front helmet opening (clockwise in the herein appended figures), that is towards that position of the same countering element 1 wherein the stable locking of the follower 3, and hence of the chin guard 4, may occur, as will be mentioned later.

It has to be observed that, in the particular embodiment of the invention herein illustrated, the rotation center C2 of the disc 2.5 coincides with the rotation center of the chin guard 4 and is spaced from the hinge C1 of the countering element 1. However, any other alternative embodiment is likewise possible, wherein the rotation center of the disc 2.5 coincides with the rotation center of the countering element 1, or further wherein the rotation centers of the disc 2.5 and the countering element 1 coincide with the rotation center of the chin guard 4 too, as well as it is possible that the regulating means 2 are not of rotatable type, but they are, for example, composed of an appropriate cursor able to limit the motion and/or to place in apposite positions the aforesaid countering element 1.

Figure 2:
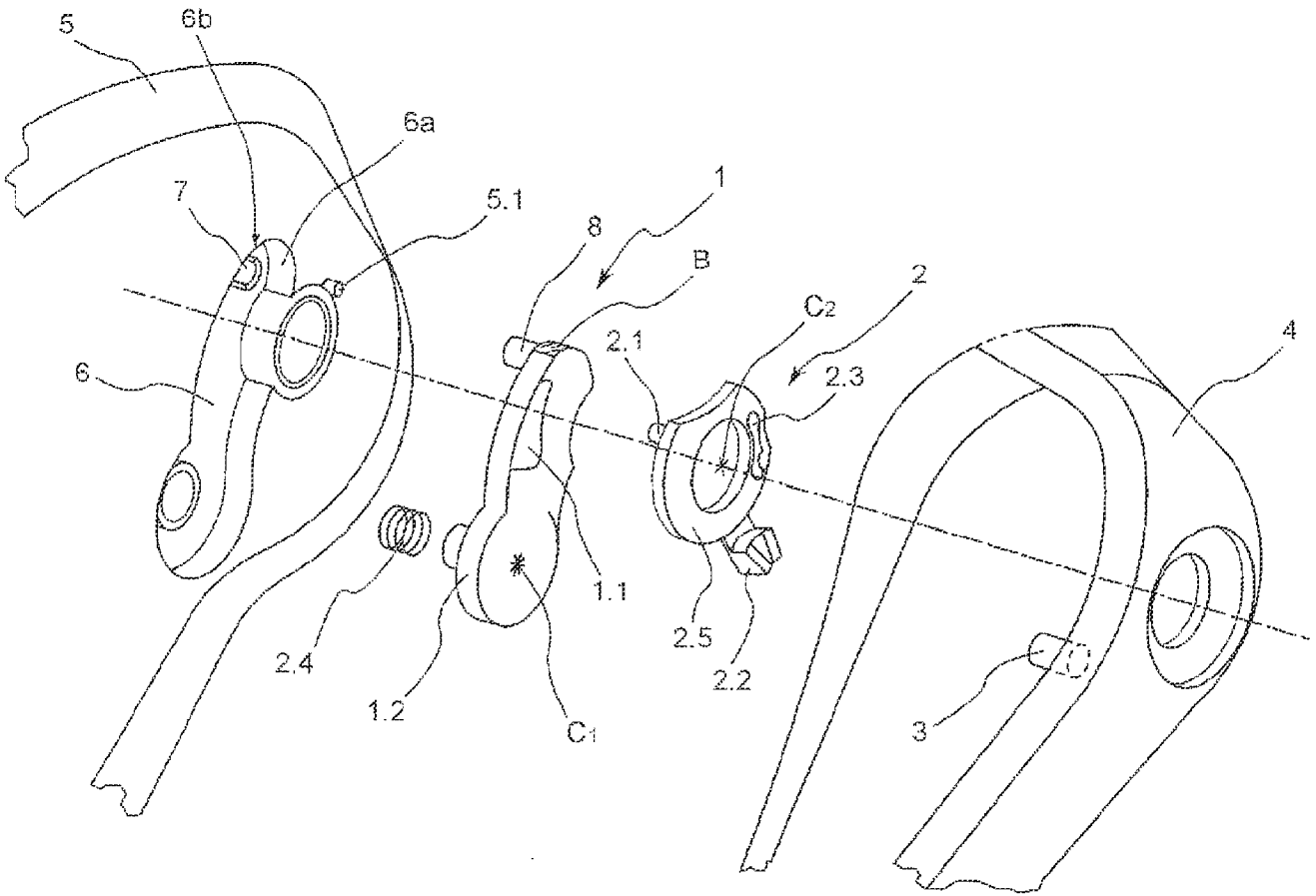
FIG. 2 is a side exploded view of a reversible device for locking the chin guard in a raised position, usable, according to an aspect of the present invention, in the helmet of FIG. 1.

The means 2 for manually regulation herein illustrated comprise as well a grooved slot 2.3 inside which a peg 5.1 is slidingly fitted, integral in a protruding manner from the shell 5 (see FIG. 2). The slot 2.3 is shaped so that to present two stable ending positions for the peg 5.1, spaced by an elastically deformable region that is shaped so that to cause the peg 5.1 to place in one or in the other of the stable ending positions of the slot itself 2.3.

The grooved slot 2.3 and the peg 5.1 of the shell 5 force the control 2.2 to stably reach only one of the two limit-stop position determined by the geometry of the corresponding seat 9 having a circular sector, preventing such a manual control 2.2, and then the striker 2.1, from being in intermediate positions between the limit-stop positions for the same control 2.2.

Figure 3:
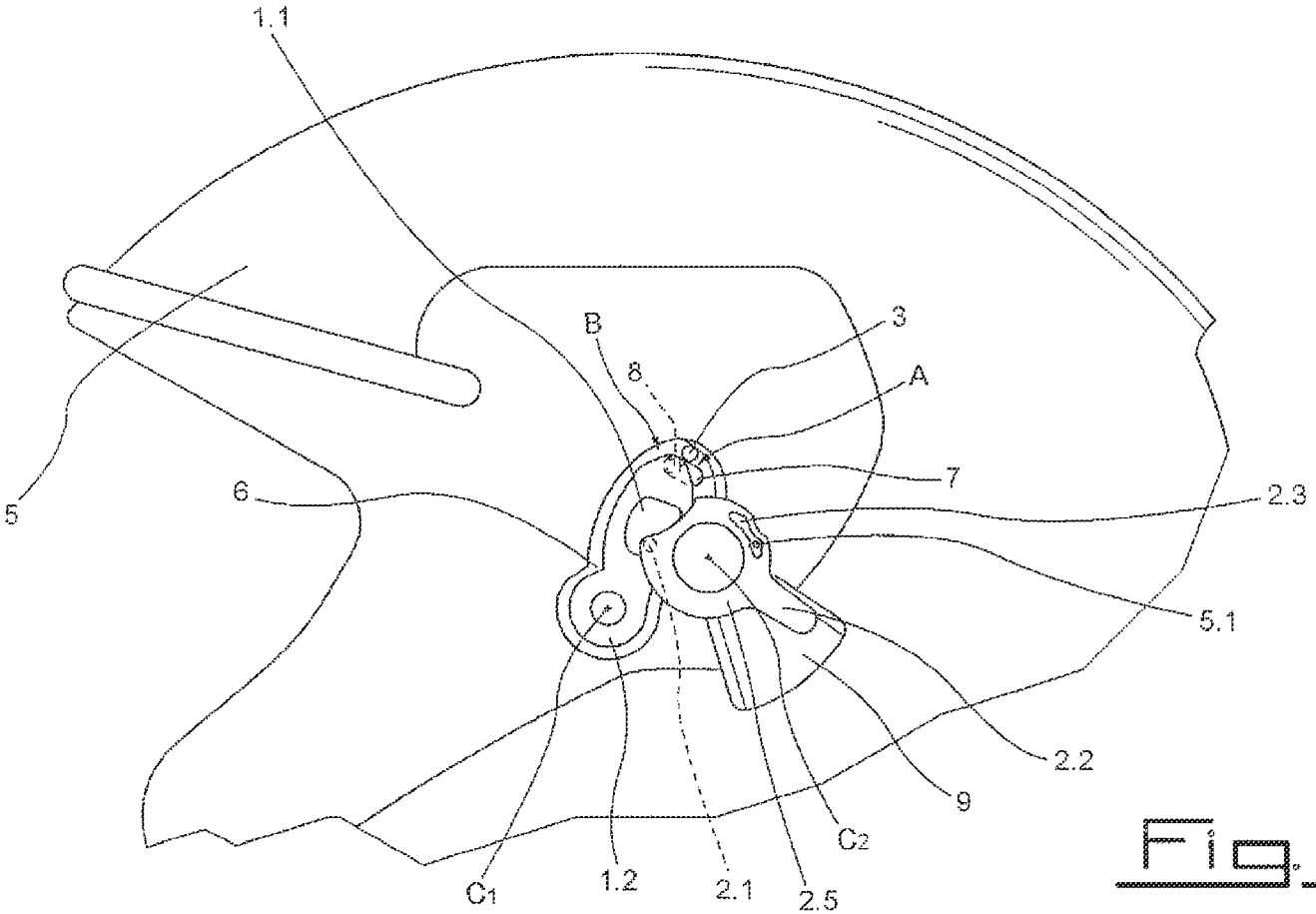
FIG. 3 is a partially sectioned schematic view of the device in FIG. 2, when the chin guard is stably locked in the raised position.

According to the present invention, particularly referring to FIGS. 3 and 6, the reversible locking of the chin guard 4 in a raised position over the shell 5, is assured by the engagement coupling, by contrast of rigid parts, of the aforesaid at least one superficial portion A of the upper head of the body 1.2 of the countering element 1, with a complementary contacting surface of which the follower 3 is provided with.

As will be later described more in detail, such a reversible locking occurs when the countering element 1 is placed by the user, thanks to the aforesaid means 2 for manually regulating the position and/or the motion of the same countering element 1, in such a position that the path of the follower 3 would intersect the aforesaid surface A, this latter rigidly countering the follower 3, and the manually regulating means 2 resulting placed as well in such a way to prevent the countering element 1 to move from such a stable locking position, by contrast of rigid parts, of the same follower 3.

In this latter position, the shape of the superficial portion A, its geometrical arrangement relatively to the follower 3 (that is the fact that the portion A intersects the path of this latter), when the follower 3 and the countering element 1 have respectively an appropriate reciprocal arrangement with the chin guard 4 in the raised position, allows the same follower 3 to be locked, by contrast of rigid parts, by the countering element 1, because of the means 2 for regulating the motion and/or the position of the countering element 1 would maintain stably, in such a locking position, the follower 3 with the countering element 1, or better they would prevent the countering element 1 from rotating (clockwise in figures) in such a way to free the path of the follower 3 from the superficial portion A of the same countering element 1.

More in detail, in this stable locking position, the manually regulating means 2 place the countering element 1 in such a position that its superficial portion A intersects the path of the follower 3, that, once arrived at its limit-stop position, is placed—with a certain clearance—between the limit stop **6*a* of its guide 6*b* and the same superficial portion A of the countering element 1, and in the meanwhile they prevent this latter to rotate, clockwise in figures, so that to disengage the follower 3** itself.

Particularly, referring to FIGS. 3 and 6, when the countering element 1 is in its stable locking position for the chin guard 4, in the particular embodiment of the present invention herein shown, the superficial portion A of the countering element 1 is tilted so that any movement of the follower 3 in the direction closing the chin guard 4 (in the anticlockwise direction in FIG. 3) tends to cause, thanks to the engagement, by contrast of rigid parts, of the same follower 3 on its superficial portion A, a corresponding anticlockwise rotation of the countering element 1; rotation of the countering element 1 that is prevented by the striker 2.1 of the manually regulating means 2 inside the guide 1.1 of the same countering element 1 and by the small tooth 8 reaching the limit stop inside the guide 7, as well as by the possible contact of the countering element 1 itself against the walls **6*b* of the seat 6**.

As mentioned yet, according to a preferred aspect of the present invention, the upper head of the body 1.2 of the countering element 1, that is that part of the element 1 opposite from its hinge C1, presents a second superficial portion B too, that is conveniently shaped and may be placed, thanks to manually regulating means 2, such that to intersect the path of the follower 3 to allow an instable rest only, and wherein the manually regulating means 2 hold only temporarily, thanks to the action of the spring 2.4, the countering element 1 in such an instable engagement position.

Figure 4:
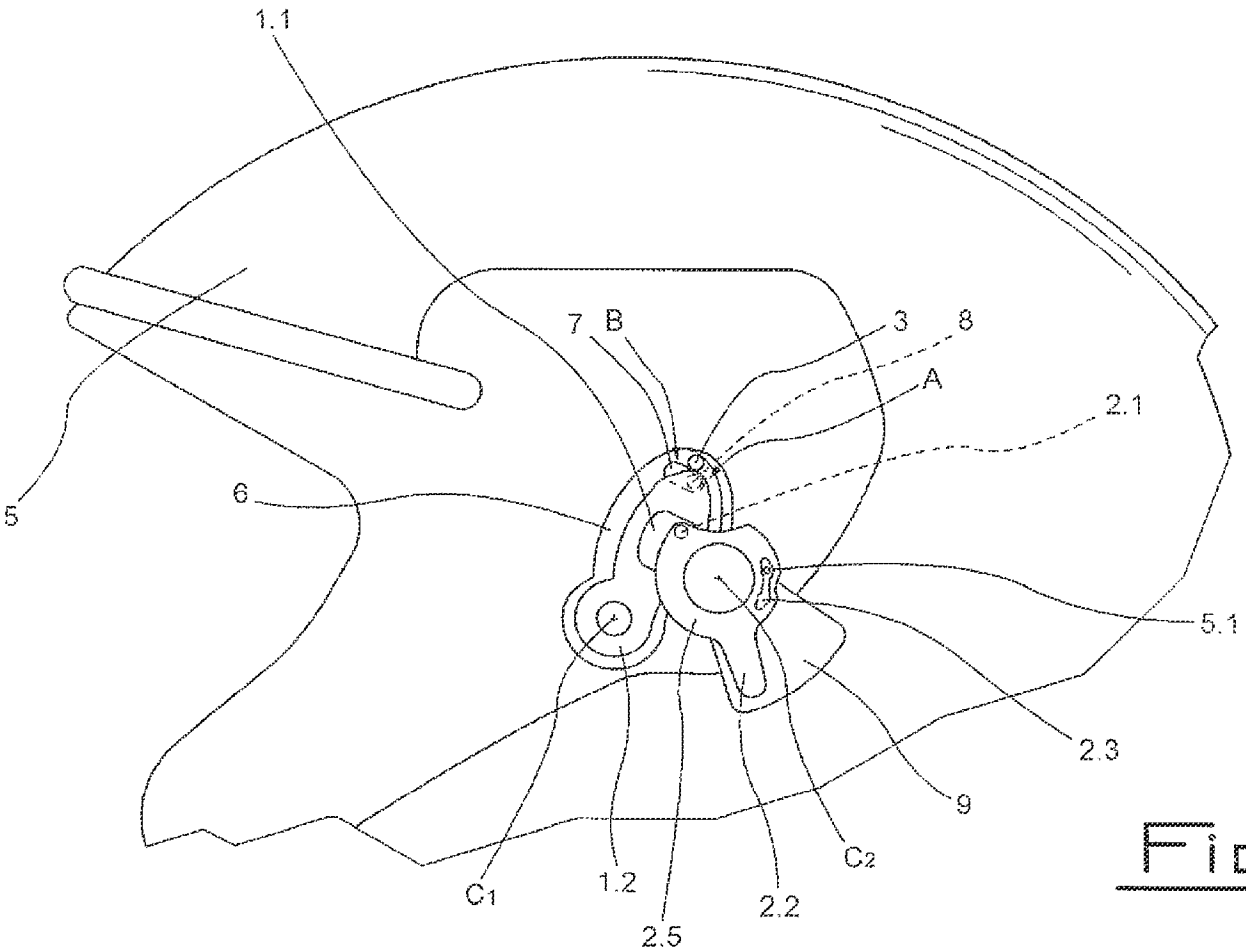
FIG. 4 is a partially sectioned schematic view of the device in FIG. 2, with the chin guard rested in a yielding way in a raised position.

More particularly, as can be appreciated from FIGS. 4 and 7, in such an instable engagement position for the follower 3, thanks to the particular arrangement of the countering element 1 and of the manually regulating means 2, the follower 3 is placed, with a certain clearance, between the aforesaid limit-stop surface **6*a* of the seat 6 and the rest obtained by the superficial portion B of the body 1.2 of the countering element 1, and this latter is held in such a position, wherein the surface B just intersects the descending path of the follower 3, by the spring 2.4 only, this latter opposing to the rotation (clockwise in the figure) of the countering element 1, which rotation would free the path of the follower 3** itself, thereby causing the disengagement thereof.

It has to be observed that, in the particular embodiment of the invention herein illustrated, the shape of the superficial portion B, its arrangement relatively to the seat 6 and the follower 3, and the fact that the regulating means 2 hold elastically only (by the spring 2.4) the surface B in a position intercepting the follower 3, are such to allow a yielding rest only of the follower 3 on the portion B.

More in detail, when the regulating means 2 place the countering element 1 in its instable engagement position (illustrated in FIGS. 4 and 7), the superficial portion B of yielding rest for the countering element 1, intersecting the path of the follower 3, will reach such a tilt that, once the follower 3 is placed between its limit stop 6*a* and such a superficial portion B, any rotational movement of the follower 3 in the direction closing the chin guard 4 (anticlockwise in figures) will cause, thanks to the rest created between the follower and the superficial portion B, a corresponding rotation in the opposite direction (clockwise) of the same countering element 1, such a rotation being impeded substantially by the return spring 2.4, interposed between the shell 5 and such a countering element 1.

If the force causing the follower 3 rotation in the direction closing the chin guard 4 (anticlockwise in figures) would be upper than the force opposite to the spring 2.4, the regulating means 2 would allow the countering element 1 to rotate (clockwise in FIG. 1) in such a way to release the follower 3 from the superficial portion B, allowing the same follower to continue its run along the guide 6*b*, resting on the side portion of the body 1.2 of the countering element 1.

It has to be noticed also that the superficial portion B, in the particular embodiment of the invention herein shown, comes immediately before the superficial portion A, having regard to the run of the follower 3 during the raising of the chin guard 4 and, in its turn, is preceded by a side surface of the countering element 1 that, as said, acts as a guide for the follower 3 itself, the countering element 1 being pushed towards the follower 3 by the spring 2.4

As will be evident for a person skilled in the art, any other means able to assure a yielding rest for the follower 3, preferably but not exclusively in an elastic manner, such as for example the presence of elastic reliefs projecting from the surface B, or the realization of the surface B with a complementary geometry with the surface of the follower 3, such that, in certain reciprocal spatial arrangements of the countering element 1 and the follower 3, an instable (yielding) rest of this latter on the same element 1 could occur, will fall in the protection scope requested for this invention.

It has to be noticed that, although in the particular embodiment of the present invention herein illustrated the countering element 1 is hinged into the shell 5, whereas the follower 3 is integral with the chin guard 4, it is obviously possible to carry out, even if in a more difficult manner, a device for reversibly locking the chin guard 4 in a raised position, wherein the countering element is constrained, with at least one degree of freedom, to the chin guard 4 and the follower 3 is integral with the shell 5 of the safety helmet.

Further, it has to be observed that the reversibly locking device of the chin guard 4 in a raised position is placed at only one side of the shell 5, whereas at the opposite side of the shell 5 may be present a different locking device, or a similar device, or furthermore an auxiliary device aiding the maintaining of the chin guard 4 in its raised position, in a symmetric way from one side to another of the same shell 5.

Now referring particularly to FIGS. 2, 3, and 4, 6, and 7, the operation of the device for reversibly locking the chin guard in the raised position will be described more in detail, according to a preferred embodiment of the invention herein illustrated.

Firstly considering the situation wherein the manual control 2.2 of the regulating means 2 is placed by the user in such a limit-stop position thereof, within the corresponding seat 9, into which a stable locking of the chin guard 4 in its raised position is obtained (FIGS. 3 and 6), the countering element 1 is placed such that the superficial portion A of its upper head (opposite to the hinge C1) is placed in such a way to intersect the path of the follower 3 integral with the chin guard 4 and to be substantially in a position in front of the limit surface 6*a* of the seat 6 for the same follower 3.

In such a position, the striker 2.1 of the regulating means 2 engages the guide 1.1 of the body 1.2 of the countering element 1 in a position preventing any further rotation of the countering element 1 toward the front opening of the helmet (anticlockwise in figures), in conjunction with the engagement of the small tooth 8 inside the circular guide 7 of the shell 5 in a corresponding limit-stop position, but does not impede possible rotations in the opposite direction (clockwise in figures) of the same countering element 1.

In case wherein the chin guard 4 is in its completely pulled down position for protective the user face, the corresponding follower 3 is placed, within the seat 6, in contact with the inner wall 6*b* of this latter and with the side surface of the body 1.2 of the countering element 1, in an adjacent position with the rotation center C1 of the countering element 1 itself.

With the countering element 1 placed by the means 2 in the stable locking position shown in FIGS. 3 and 6, and the follower 3 placed inside the seat 6 in proximity of the hinge C1, the raising rotation of the chin guard 4 thereby causes the corresponding rotation of the follower 3 within the guide composed by the wall 6*b* of the seat 6, with a consequent little movement of the rotating countering element 1, around C1, in the moving away direction from the front opening of the helmet (that is clockwise in figures), the movement being necessary for allowing the same follower 3 to go past inside the seat 6, while impeded by the action of the spring 2.4 (not shown in FIGS. 3 and 6).

Once the chin guard 4 is arrived in the raised position, the follower 3 reaches the position shown in FIGS. 3 and 6, that is a position wherein it is interposed between the limit-stop surface 6*a* and the superficial portion A of the upper head of the same countering element 1, this latter being pushed in this position by the spring 2.4, when the follower 3 has crossed the superficial portion B and has been placed substantially at its limit stop 6*a*.

In this position, as mentioned, the superficial portion A intersects the path of the follower 3 and prevents any rotation of the same follower 3 in the pulling down direction of the chin guard 4, by contrast of rigid parts.

In fact, the geometry of the superficial portion A, and its arrangement relatively to the path of the follower 3, is such that any force acting to the chin guard 4 in the pulling down direction of this latter (anticlockwise in figures) causes the rest of the follower 3 on the superficial portion A, in such a way that any thrust in such a direction is transformed in a rotation thrust to the countering element 1 directed to the same direction (that is anticlockwise).

But such a possible rotation thrust (anticlockwise) acting on the countering element 1 is stably impeded either by the engagement, at the limit stop, of the pin 8 inside the corresponding circular guide 7 and, eventually, by the stroke of the side surface of the same countering element 1 against the inner surface 6*b* of the seat 6, and by the engagement of the striker 2.1 inside the guide 1.1.

Therefore, in such a stable locking position, the chin guard 4 could not be moved again in its pulled down position, because the follower 3 integral thereto, although having a certain clearance between the limit stop 6*a* and the superficial portion A of the countering element 1, could not cross such a superficial portion A, by contrast of rigid parts.

In order to be able to disengage the chin guard 4 from such a stable locking position, the user must then necessarily act on the control 2.2, in such a way to push (by the interaction between the striker 2.1 and the guide 1.1) the countering element 1 to place in its position wherein the follower 3, in the raised position of the chin guard 4, is not held anymore by the superficial portion A, but it is held by the superficial portion B of yielding rest, that is the follower 3 is placed between its limit stop 6*a* and such a superficial portion B.

Therefore the user, acting on the control 2.2 so that to move it in its second limit-stop position (shown in FIGS. 4 and 7), inside the corresponding seat 9, causes the rotation of the striker 2.1 around the hinge C2, the striker 2.1 causing the countering element 1 to rotate around its own hinge C1, overcoming the force exercised by the spring 2.4, in a direction moving away from the front opening of the helmet, that is clockwise in figures.

It has to be noticed that the control, or activating lever 2.2, could be reach its limit-stop positions inside the corresponding seat 9, because of the engagement of the pin 5.1, integral with the shell 5, inside the elastic slot 2.3 of the disc 2.5.

In such a position, reached also thanks to the existing clearance between the follower 3, its limit-stop surface 6*a* and the superficial portion A of the countering element 1, this latter is not held anymore by the limit-stop detents and, on the contrary, it could further rotate, also if it has to overcome the strength opposed by the spring 2.4, clockwise (in figures).

As mentioned yet, in this arrangement of parts composing the reversible locking device according to the present invention, the tilt and the spatial arrangement of the superficial portion B of the countering element 1, relatively to the follower 3, is such that any thrust acting on the follower 3 itself and directed in the direction pulling down the chin guard 4 (that is anticlockwise in figures), causes, thanks to the yielding rest of the follower 3 on the superficial portion B, a corresponding thrust in the opposite direction, that is clockwise in the figures, of the same countering element 1.

Such a clockwise thrust, thanks to the arrangement adopted by the regulating means 2, is now opposed substantially by the spring 2.4 only and it is thence sufficient that the extent of this thrust is upper than the return force exercised by the spring 2.4 to allow the follower 3 to disengage from the aforesaid superficial portion B and follow the guide 6*b* up to place in proximity of the hinge C1 of the countering element 1, thereby allowing the pulling down of the chin guard 4.

When the follower 3 is arrived in this position, and the regulating means 2 remaining in the instable engagement position illustrated in FIGS. 4 and 7, the possible subsequent raising of the chin guard 4 causes firstly the follower 3 to run upwardly (in figures) into the seat 6, with a consequent little rotation, opposed by the spring 2.4, of the countering element 1 moving away from the front helmet opening (that is anticlockwise, in figures), and then the arrangement of the follower 3 in a limit-stop position, placed between the limit-stop surface 6*a* of the seat 6 and the superficial portion B of the countering element 1.

In this case, the rest of the follower 3 on the superficial portion B, as mentioned, is yielding, because only the spring 2.4 is opposing to the possible rotation, anticlockwise in figures, of the same follower 3 and the of the chin guard 4.

In case wherein, from this last disengagement instable position reached by the follower 3, and then by the chin guard 4 in a raised position, the user wants to lock the chin guard 4 in a stable manner, the subsequent rotation of the control 2.2 towards its opposite limit-stop position causes the rotation (downwards in figures) of the striker 2.1 into the guide 1.1, until such a striker 2.1 will reach inside the guide 1.1 a position able to allow the anticlockwise rotation (in figures) of the same body 1.2 of the countering element 1, in its position suited for stably locking the follower 3.

At this point, the contemporaneous action of the spring 2.4 tending to anticlockwise push the countering element 1, in rotation around its own hinge C1, and the existing clearance between the follower 3 and the upper head of the same countering element 1, will allow the device parts herein described to come back in the stable locking position illustrated in FIGS. 3 and 6, wherein the movement of the follower 3 and then the pulling down of the chin guard 4 are not allowed.

As it is evident from what above described, the operation of manually regulating means 2 of motion and/or position of the countering element 1 allows alternatively to place the chin guard 4 in a stable locking position, when the follower 3 at the end of the raising run engages the superficial portion A of the same countering element 1, that is opposing, by contrast of rigid parts, to the pulling down of the chin guard 4, or in an instable engagement position, when the follower 3, once raised the chin guard, engages on the contrary the superficial portion B, impeding only elastically the possible pulling down of the chin guard 4.

The invention claimed is:

1. Safety helmet of the type comprising:

a shell with a front opening, the shell defining an interior space;

a chin guard rotatably pivoted to the shell, the chin guard rotatable between a pulled down position, at the lower end of the front opening of the shell, and at least one raised position over the front opening;

at least one reversible locking device for locking and unlocking the chin guard in the at least one raised position, the reversible locking device positioned intermediate the shell and the chin guard at a position proximal to the chin guard being pivoted to the shell, the reversible locking device comprising, at least one follower, integral and thereby rotatable with the chin guard, the follower extending from the chin guard towards the interior space of the shell, and at least one corresponding countering element hinged to the shell, the countering element and the follower being shaped for mutual engagement at least when the chin guard is proximal to the raised position allowing locking of the chin guard in the raised position; and a means for manually regulating the motion of the at least one countering element, the means comprising a rotatable disk to be activated by an end-user, the rotatable disk positioned intermediate the countering element and the chin guard, the rotatable disk hinged to the shell with an integral striker extending towards the interior space of the shell, the striker engaged with the countering element to inhibit the rotation of the countering element when the rotatable disk is activated to lock the chin guard;

wherein the countering element is movable between at least one locking position for locking the follower and the chin guard when the chin guard is in proximity of its raised position, and at least one disengagement position for unlocking the follower and the chin guard from the countering element.

2. Safety helmet according to claim 1, wherein the countering element is movable in an resting position of unstable engagement for the follower, when the chin guard is in proximity of the raised position, the means for regulating the the motion of the countering element being able to temporarily hold the countering element in the resting position of unstable engagement for the follower.

3. Safety helmet according to claim 2, wherein the means for regulating the motion of the countering element operate the countering element between the resting position of unstable engagement of the follower and the locking position the follower; the means preventing the free movement of the countering element from the position of unstable engagement to the locking position.

4. Safety helmet according to claim 1, wherein the countering element comprises at least one first portion (A) for the stable rest of the follower, the first portion (A) engaging the follower, when the countering element is held in the locking position.

5. Safety helmet according to claim 1, wherein the countering element comprises at least one second portion (B) for yielding rest for the follower, the countering element being movable in the resting position of unstable engagement of the follower on the second portion (B), when the chin guard is in proximity of the raised position, and the means for regulating the motion of the countering element being able to temporarily hold the countering element in the resting position of unstable engagement of the follower.

6. Safety helmet according to claim 1, wherein the follower slides relative to the shell inside a guide provided with at least one upper limit-stop surface for follower.

7. Safety helmet according to claim 6, wherein there is a clearance between the follower and the countering element, when the follower contacts the limit-stop surface of the guide.

8. Safety helmet according to claim 1, wherein the means for regulating the movement of the countering element comprise at least one return spring for returning the countering element towards the locking position for the follower.

9. Safety helmet according to claim 8, wherein the return spring for the countering element opposes the movement of the countering element towards the disengagement position from the follower.

10. Safety helmet according to claim 1, wherein the countering element is pivoted (C1) to the shell.

11. Safety helmet according to claim 1, wherein the striker regulates the movement of the countering element by engaging a guide positioned in the countering element.

* * * * *